US006280263B1

(12) United States Patent
Manor et al.

(10) Patent No.: US 6,280,263 B1
(45) Date of Patent: Aug. 28, 2001

(54) ANTI-ROTATION TERMINAL WITH CAPTURED NUT

(75) Inventors: Michael Anthony Manor, Southgate; Kazuhiro Shimizu, W. Bloomfield; Takeshi Takahashi, Novi, all of MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 09/561,633

(22) Filed: May 2, 2000

(51) Int. Cl.[7] ..... H01R 4/30; H01R 4/38
(52) U.S. Cl. ..... 439/801; 439/813; 439/883
(58) Field of Search ..... 409/801, 883, 409/761, 762, 763; 439/813, 883

(56) References Cited

U.S. PATENT DOCUMENTS

| | | | | |
|---|---|---|---|---|
| 4,842,557 | * | 6/1989 | Muz | 439/851 |
| 4,875,876 | * | 10/1989 | O'Loughlin | 439/431 |
| 4,900,259 | * | 2/1990 | Ludwing et al. | 439/107 |
| 4,905,122 | | 2/1990 | Culnan et al. . | |
| 5,183,419 | | 2/1993 | Dewar . | |
| 5,492,780 | * | 2/1996 | Okada | 429/121 |
| 5,547,403 | * | 8/1996 | Haberstroh et al. | 439/763 |
| 5,588,883 | | 12/1996 | Hattori . | |
| 5,655,936 | | 8/1997 | Meredith . | |
| 5,842,894 | | 12/1998 | Mehlberg . | |
| 5,863,227 | | 1/1999 | Bell . | |

OTHER PUBLICATIONS

Reference Drawing, Burnett Jason; Jun. 30, 1997, Canton, Michigan.

* cited by examiner

*Primary Examiner*—Lincoln Donovan
*Assistant Examiner*—Kyung S. Lee
(74) *Attorney, Agent, or Firm*—Young and Basile, P.C.

(57) ABSTRACT

An eyelet terminal for use in a vehicle junction box or power center to connect a bus bar to an electrical wire or cable. The terminal assembly is formed as a flat metal blank with bendable portions defining a nut-trapping lock ring, an anti-rotation tab, and wire crimping tabs. One end of the terminal includes an eyelet portion having an aperture for a bolt or threaded stud, and a surface for rotatably supporting a flanged nut over the aperture. The lock ring is formed at the end of a leg or arm extending from the eyelet portion and adapted to be bent over a radius to a nut-trapping position over the nut flange and aligned with the eyelet portion. A bendable anti-rotation tab extending from the lock ring is bent from an initial flat position to a right-angled position in which it extends through a suitable aperture in the terminal when the lock ring is in the nut-trapping position. The portion of the anti-rotation tab extending through the terminal is adapted to engage a mating receptacle in a bus bar or junction box housing to prevent the eyelet terminal from rotating when the nut is tightened in one-handed fashion.

16 Claims, 3 Drawing Sheets

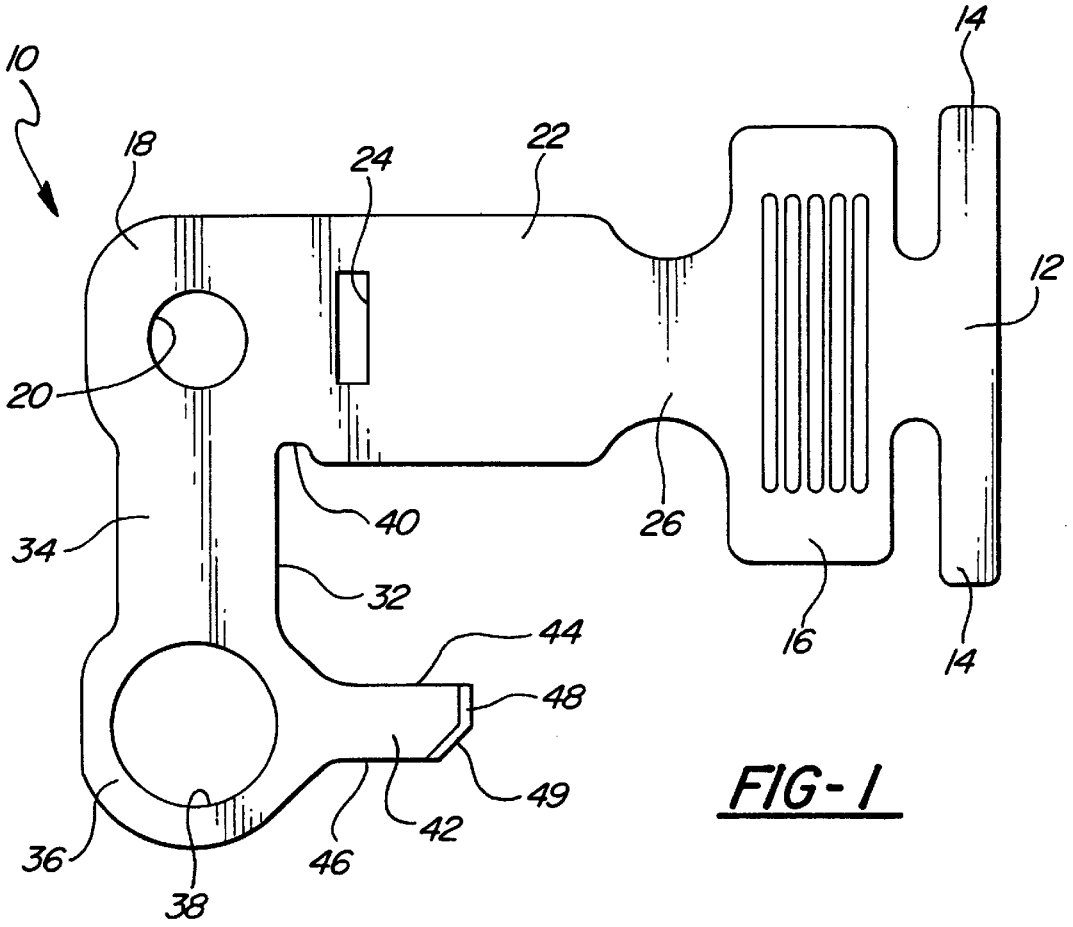
FIG-1
FIG-2
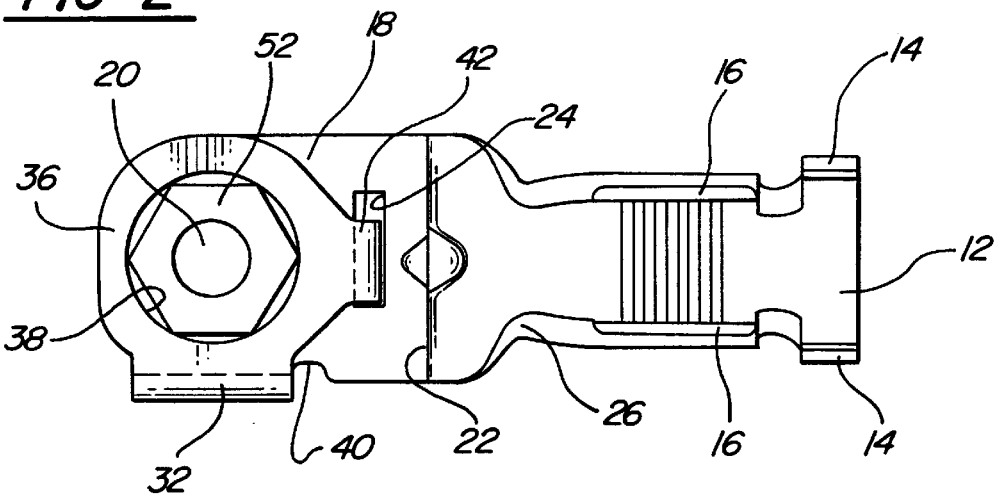

FIG-5
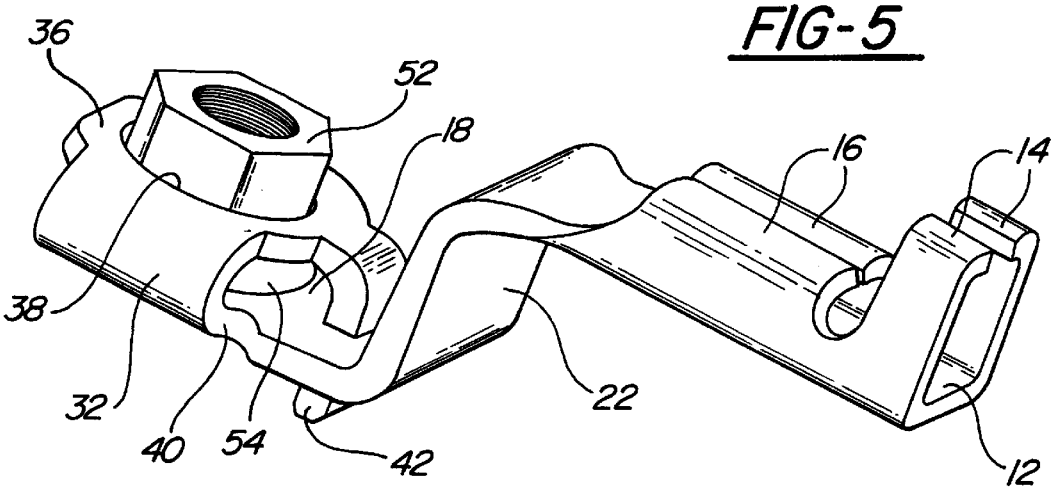
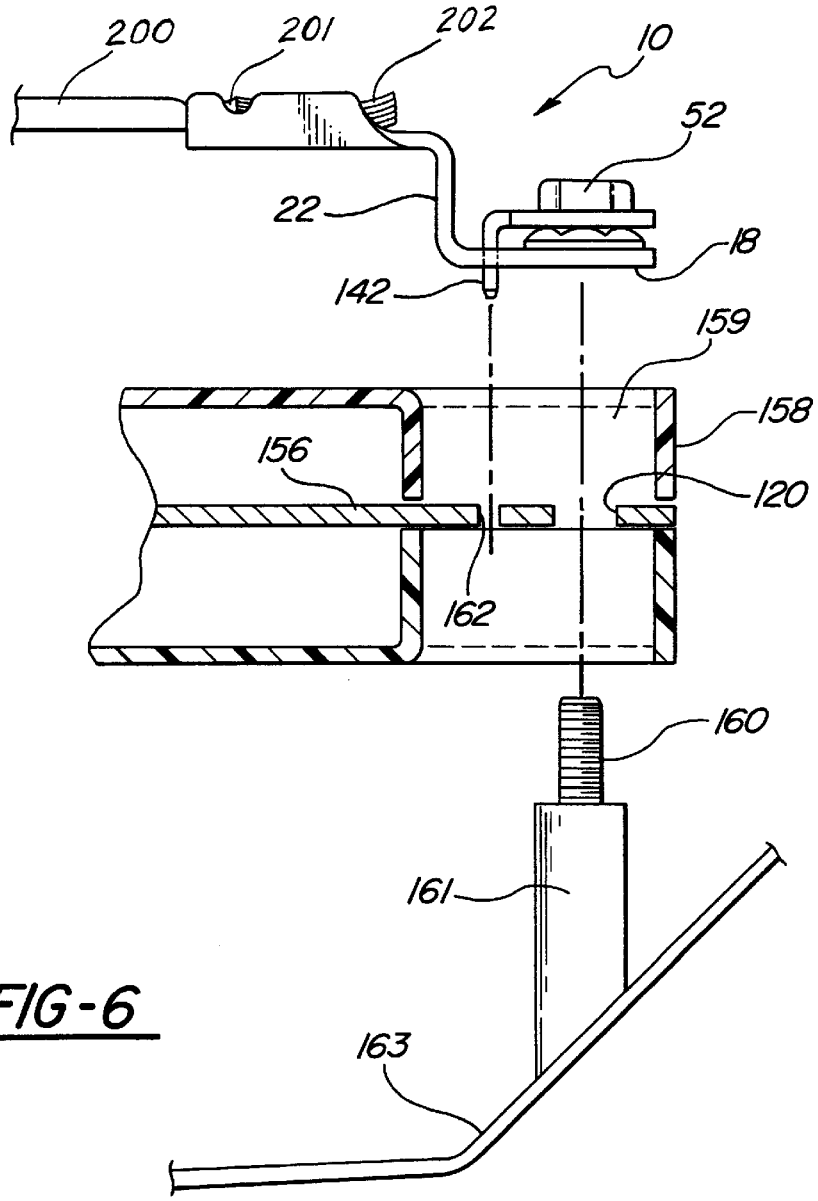
FIG-6

ANTI-ROTATION TERMINAL WITH CAPTURED NUT

BACKGROUND OF THE INVENTION

1. Field of the Invention

This invention is in the field of eyelet terminals of the type used in automotive junction boxes for connecting electrical wires and cables to threaded terminal posts.

2. Discussion of Related Art

Electrical connection of an eyelet terminal to a bolt or stud in a vehicle electrical system typically requires manipulation of three pieces: eyelet terminal, nut and tool. The nut is easily dropped, leading to higher scrap cost and possibly impairing the vehicle's function. A shortage of either eyelet terminals or nuts in a sub-assembly can hold up the entire vehicle assembly operation. Attempting to tighten an eyelet terminal on a battery or grounding stud is difficult and awkward since the terminal tends to rotate with the nut and tool, especially if space constraints require a one-handed operation.

One prior art solution to the foregoing problems is the use of an eyelet terminal with a nut rotatably captured over the eyelet. Such captured nut terminals proved useful for low amperage (40–50 amps) applications allowing the use of relatively small gage wire (e.g. 12 AWG) and thin, easily folded metal blanks for the terminals. Such terminals are not useful for high-amperage vehicle applications of the type increasingly encountered in the automotive industry, requiring thicker terminal metal, larger wire, and bus bar contact capability. Moreover, the special squared-flange, washer-type nuts needed in such terminals are expensive.

SUMMARY OF THE INVENTION

The invention is a high-amperage, bus bar contacting, trapped nut eyelet terminal stamped from a relatively thick, flat metal blank and capable of using a standard hex flange nut. The terminal has a flat eyelet section at one end, with an aperture for a threaded terminal post. A nut-trapping leg extends laterally from the eyelet section, comprising a foldable tab terminating in a lock ring with an aperture sized to fit over a nut. During assembly, a flanged nut is placed on the eyelet section and the lock ring is folded over the nut thereby rotatably trapping the flange to allow rotation of the nut on the eyelet section.

The lock ring preferably includes an integral anti-rotation tab, which is preferably formed as a flat extension of the lock ring and which can be folded down to extend through a slot in the terminal to engage a mounting surface underneath the terminal, thereby preventing the terminal from rotating as the trapped nut is tightened on a threaded stud or bolt. This anti-rotation feature facilitates one-handed operation.

The captured nut reduces human error in assembling the terminal connection, and less time is spent gathering components. There are fewer part numbers to track at the assembly plant. The possibility of similar looking but non-mating parts being assembled is eliminated.

The ability to form the terminal from a single flat piece of metal reduces cost and simplifies production.

The invention, together with other objects, features, aspects and advantages thereof, will be more clearly understood from the following description, considered in conjunction with the accompanying drawings.

BRIEF DESCRIPTION OF THE DRAWINGS

FIG. 1 is a top view of an eyelet terminal according to the present invention, formed from a flat piece of metal.

FIG. 2 is a top view of the terminal of FIG. 1 and a nut rotatably trapped thereon after the initially flat terminal has been formed by bending to capture the nut and to establish connection with an electrical wire.

FIG. 5 is a perspective view of the terminal and nut assembly of FIG. 2.

FIG. 6 is an exploded elevational side view of the terminal and nut assembly of FIG. 6 relative to a mounting well and stud bolt terminal in a common junction box mounting structure.

DETAILED DESCRIPTION OF THE ILLUSTRATED EMBODIMENT

Figure 3:
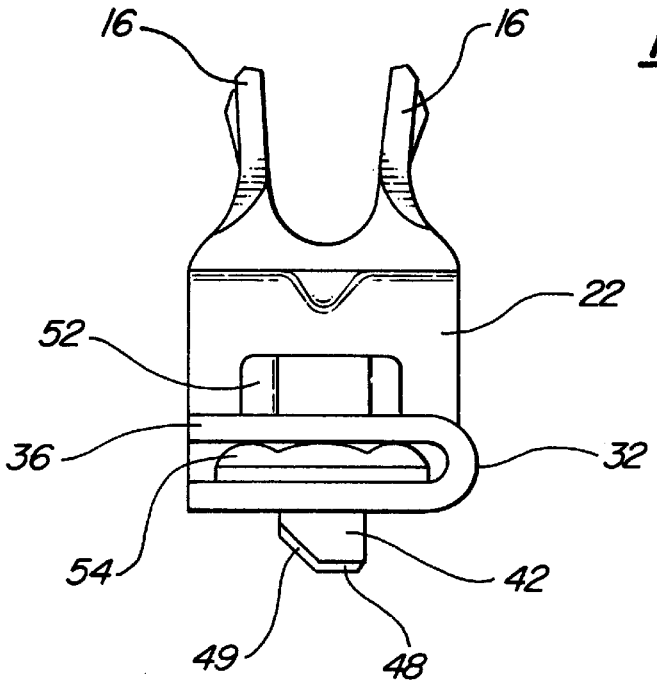
FIG. 3 is an end view of the terminal and nut assembly of FIG. 2.

Referring now to FIG. 1, an eyelet terminal 10 according to the present invention is preferably formed from a flat blank of electrically conductive metal such as copper with a tin plating. A first end of terminal 10 has a wire connecting stem 12 for crimping around the bare end of an electrical wire or cable (not shown) in conventional manner to form a secure electrical connection. To this end stem 12 has two sets of crimping tabs. A first set of crimping tabs 14 is typically crimped around an insulated portion of the wire and a second set of crimping tabs 16 is crimped onto a bare portion of the wire. The electrical wire is typically from a vehicle battery, but may also go to ground or to an electrical component.

A second end of terminal 10 comprises an eyelet section 18 having an aperture 20. The middle portion of terminal 10 is denoted as center section 22 connecting wire stem 12 to eyelet section 18. The center section includes an aperture or slot 24 adjacent eyelet section 18, and narrows to a neck segment 26 adjacent wire connecting stem 12. A bendable nut-trapping leg 32 extends at right angles from eyelet section 18, terminating in a lock ring 36.

Trap leg 32 is illustrated as having a reduced-width intermediate portion 34 connecting ring 36 to eyelet section 18. A relief notch 40 is formed where portion 34 joins the eyelet section. An anti-rotation tab 42 extends at right angles from lock ring 36 generally parallel to center section 22, positioned to be bent for alignment with and insertion into slot 24. Illustrated tab 42 is generally rectangular with an edge 44 facing the terminal, an opposite facing edge 46, and an edge 48 at a free end of the tab furthest from the capture portion. The edge 48 is straight for a short length from edge 44 but is chamfered at 49 for the rest of its length toward the opposite facing edge 46.

It will be noted from FIG. 1 that nut-trapping lock ring 36 has a nut aperture 38 larger than aperture 20 in eyelet section 18. The centers of apertures 38 and 20 are aligned along a line bisecting leg 32, and leg 32 has a length, thickness, and bend radius designed to allow lock ring 36 to be bent in an arc toward eyelet section 18 so that nut aperture 38 lies over and is coaxial with bolt aperture 20. The relief notch 40 eases the bending operation, locating the initial deformation and relieving stress which might otherwise fracture leg 32 at its connection with eyelet section 18.

The high amperage terminal applications for which the illustrated terminal is particularly well suited requires a much thicker material than is normally used. For example, eyelet section 18, leg 32 and lock ring 36 as illustrated are on the order of 2.3 millimeters thick. For such a thickness, the bend radius might be on the order of 1.6 millimeters. This thick terminal material not only increases the terminal's ability to conduct large amounts of current, but further increases the holding strength of the bent-over lock ring 36 on the nut.

FIG. 2 illustrates the relationship of lock ring 36 and nut aperture 38 to eyelet section 18 and bolt aperture 20, and to a standard hex flange nut 52 resting on eyelet section 18, after terminal 10 has been formed by appropriate bending operations to rotatably trap nut 52 on eyelet section 18 in alignment with bolt aperture 20. FIG. 2 also illustrates the mating relationship between anti-rotation tab 42 and slot 24 in central section 22 of the terminal. Prior to the bending of lock ring 36 from the position shown in FIG. 1 to the position shown in FIG. 2, anti-rotation tab 42 is bent at right angles to the lock ring so as to enter slot 24 when the lock ring is folded over onto nut 52 on eyelet section 18.

FIG. 2 also illustrates the preferred off-center nature of slot 24, which aids in positioning tab 42 during the assembly process. The chamfer 49 on the end of tab 42 further aids smooth insertion of the tab into slot 24.

Figure 4:
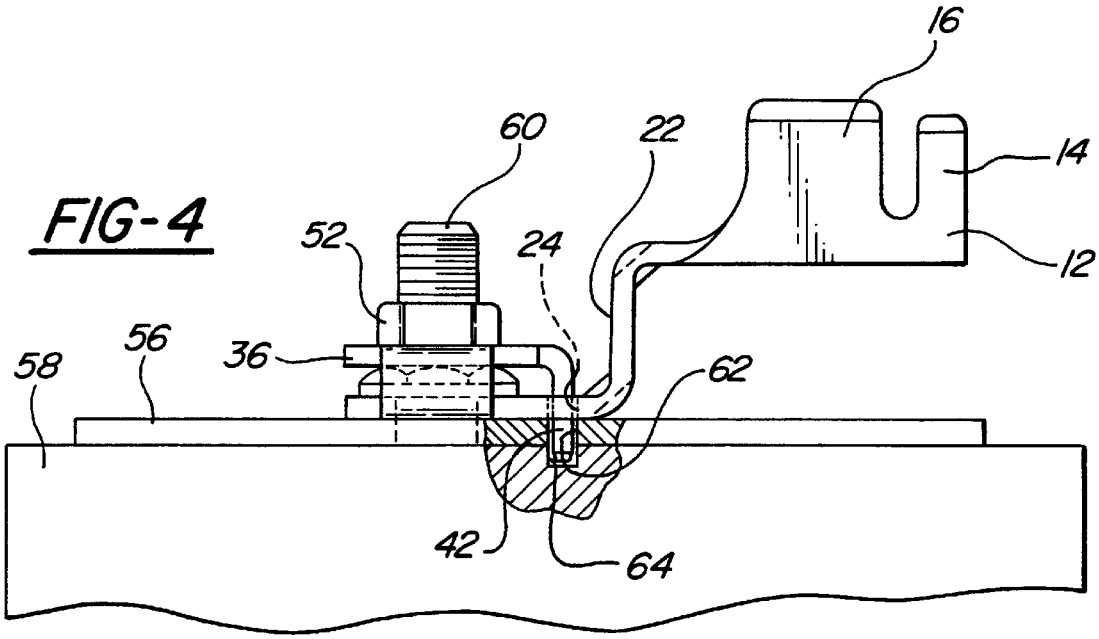
FIG. 4 is a side elevational view of the terminal and nut assembly of FIG. 2, assembled to a bus bar conductor on a mounting surface such as a bussed electrical center.

FIG. 2 also illustrates the bending of center section 22 at two right angles best shown in FIGS. 3 and 4, and the crimping of tab sets 14 and 16 to secure the electrically conductive end of a wire or cable (not shown).

The bending of various portions of terminal 10 from the flat state of FIG. 1 to the final configuration of FIGS. 2–4 can be performed using any of various known manual or automated process tools. In a preferred method, an automated forming die process is used in which lock ring 36 is bent partway toward a position overlying eyelet section 18; standard hex flange nut 52 is placed over aperture 20 on the eyelet section; and then lock ring 36 is bent down to its final position over the hexagonal head of nut 52 and onto its rounded angular flange 54 in a manner trapping the nut by the flange but allowing it to freely rotate in nut aperture 38. During these steps a portion of the forming die is used to bend center section 22 at two substantially right angles, and preferably form indentations 50 at the radii of the bends to increase their strength.

Referring to FIGS. 3 and 4, the chamfered end of anti-rotation tab 42 extends through slot 24 in the terminal and protrudes a sufficient distance underneath to engage a mating notch in an underlying mounting surface.

FIG. 4 shows one possible arrangement for mounting eyelet terminal 10 to a bus bar 56 on or in the housing 58 of a bussed electrical center, junction box, or the like. The eyelet section 18 of the pre-folded, trapped-nut terminal assembly in FIGS. 2 and 3 is placed onto the upstanding end of a bolt or threaded stud 60 extending from bus bar 56 in a desired terminal-mounting location. Once the threads of nut 52 engage the threads of bolt 60, nut 52 is rotated in its trapped, aligned position over bolt aperture 20 onto bolt 60 until the bottom of eyelet section 18 comes into contact with bus bar 56. At this point, anti-rotation tab 42 is located in apertures 62, 64 in bus bar 56 and housing 58. Tab 42 accordingly prevents the terminal from rotating as nut 52 is finally tightened to the desired degree.

FIG. 5 is simply a perspective view of the trapped nut terminal assembly 10 of FIGS. 2–4, illustrating particularly well the one-piece, folded nature of the finished assembly.

FIG. 6 illustrates an alternate application of terminal assembly 10 in an electrical panel 158 having a first recessed well or socket 159 accepting lower eyelet section 18 containing nut 52. Eyelet section 18 rests on a section of bus bar 156 adapted to receive eyelet section 18, with a flat upper surface containing tab-receiving aperture 162 and bolt-receiving aperture 120. A terminal bolt or threaded stud 160 is secured in a molded plastic post 161 extending from the lower interior of a bussed electrical center housing 163. Securing eyelet section 18 in electrical contact with bus bar 156 using trapped nut 52 and threaded bolt or stud 160 is similar to the procedure described above in FIG. 4, except that eyelet section 18 can be rested on bus bar 156 with anti-rotation tab 142 inserted in aperture 162 prior to the threads of nut 52 being engaged with the threads of bolt 160. Along with the snug reception of substantially rectangular eyelet section 18 in substantially rectangular well 159, this recessed bus bar arrangement allows for true one-handed threading and tightening of nut 52 on bolt 160 once eyelet section 18 is dropped into well 159.

FIG. 6 also illustrates a wire 200 having an insulated end portion 201 and a bare end portion 202 secured in wire connection stem 12.

It will be understood from the foregoing that the present invention eliminates the loss of parts in the terminal assembly; greatly improves one-handed assembly of a wire terminal to a bus bar or similar conductive mounting surface in the confines of a bussed electrical center or similar enclosed area; eliminates the need for costly special purpose nuts, allowing the use of standard hex flange nuts of the type illustrated; and further allows a trapped-nut type terminal to be formed initially from a flat blank and finally shaped in an automated bending process. It will further be apparent that the illustrated embodiment can be modified in obvious ways to adapt the terminal invention to different terminal locations and mounting arrangements by varying the overall shape of blank 10; adjusting the size and location of the various openings and apertures; modifying bend radii to accommodate different material and size requirements; and other ways which will be apparent to those skilled in the art now that we have disclosed a particular embodiment of the invention.

Accordingly, we claim:

1. A terminal designed for securing a wire or cable to a threaded bolt-type terminal, comprising:

an eyelet portion having a bolt aperture;

a capture portion, the capture portion comprising a leg extending from the eyelet portion, the leg having a ring portion spaced from the eyelet portion, the ring portion including a nut-trapping aperture, the leg portion being bendable about a radius adapted to place the ring portion over the eyelet portion, the ring portion adapted to rotatably trap a nut on the eyelet portion in mating alignment with the bolt aperture; and an anti-rotation projection on the terminal adapted to engage an adjacent mounting surface for preventing rotation of the terminal relative to the mounting surface when a nut is rotated in the capture portion.

2. The electrical terminal of claim 1 wherein the anti-rotation projection extends from the ring portion.

3. The electrical terminal of claim 2 wherein the terminal includes a slot adapted to receive the anti-rotation projection therethrough.

4. The electrical terminal of claim 3, wherein the terminal comprises a flat blank, and the anti-rotation projection is adapted to be bent relative to the ring portion for insertion into the slot when the leg portion is bent to place the ring portion over the eyelet portion.

5. The electrical terminal of claim 1 further comprising a wire connection portion extending from the eyelet portion at right angles to the capture portion.

6. The electrical terminal of claim 5, further comprising a center section between the eyelet portion and the wire connection portion, the center section adapted to be bent at right angles to the eyelet portion and to the wire connection portion to define a step spacing the wire connection portion above and parallel to the eyelet portion.

7. An electrical terminal assembly comprising:

an eyelet terminal with a bolt aperture;

a nut capturing portion integral with the eyelet terminal, the nut capturing portion comprising a flat ring positionable over the eyelet terminal; and an anti-rotation tab extending from the flat ring toward the eyelet terminal and extending through a slot in the eyelet terminal when the flat ring is positioned over the eyelet terminal, the tab adapted to be received within a mounting surface to prevent rotation of the eyelet terminal relative to the mounting surface.

8. The electrical terminal assembly of claim 7 further comprising a nut with a flange, the flange being rotatably captured on the eyelet terminal by the nut capturing portion.

9. An electrical terminal assembly comprising:

an eyelet terminal with a bolt aperture;

a nut capturing portion integral with the eyelet terminal, the nut capturing portion having a nut aperture for alignment with the bolt aperture in the eyelet terminal;

a nut with a flange, the flange being clamped between the nut capturing portion and the eyelet terminal with a tool-driven portion of the nut extending through the nut aperture; and an anti-rotation portion integral with the nut capturing portion and adapted to prevent rotation of the eyelet terminal relative to a mounting surface.

10. The electrical terminal assembly of claim 7 wherein the nut capturing portion further includes an intermediate portion between the eyelet terminal and flat ring, and the intermediate portion is adapted to be bent to position the flat ring over the eyelet terminal.

11. The electrical terminal assembly of claim 7 wherein the eyelet terminal comprises an eyelet section, a wire connecting stem, and a center section joining the eyelet section and wire connecting stem, the center section having the slot through which the anti-rotation tab extends.

12. The electrical terminal assembly of claim 11 wherein the nut capturing portion further comprises an arm extending from a side of the eyelet section, the flat ring being on an end of the arm distal from the eyelet section.

13. The electrical terminal assembly of claim 12 wherein the anti-rotation tab extends from the flat ring in the same direction that the center section extends from the eyelet section.

14. A terminal design for securing a wire or cable to a threaded bolt-type terminal, comprising:

an eyelet portion having a bolt aperture of a first diameter corresponding to a bolt diameter;

a flanged nut rotatably resting on the eyelet portion, the nut having a bolt receiving hole aligned with the bolt aperture;

a capture portion rotatably trapping the nut on the eyelet portion in mating alignment with the bolt aperture, the capture portion having a nut aperture of a second diameter greater than the first diameter, the nut aperture fitted over an upper portion of the nut such that the capture portion surrounds the upper portion of the nut and overlies a lower flanged portion of the nut, the nut being rotatable between the eyelet portion and the capture portion;

an anti-rotation projection on the terminal adapted to engage an adjacent mounting surface for preventing rotation of the terminal when the nut is rotated in the capture portion while threading it onto a bolt.

15. The electrical terminal of claim 14, wherein the capture portion comprises:

a leg extending from the eyelet portion with the nut aperture located on a distal end of the leg spaced from the eyelet portion, the leg portion being bent about a radius placing the nut aperture over and in alignment with the bolt aperture on the eyelet portion.

16. The electrical terminal of claim 15 wherein the anti-rotation projection extends from the capture portion adjacent the nut aperture, and further wherein the terminal includes a slot adjacent to the eyelet portion adapted to receive the anti-rotation projection therethrough.

* * * * *